US006223959B1

(12) United States Patent
Chen

(10) Patent No.: US 6,223,959 B1
(45) Date of Patent: May 1, 2001

(54) BAG HAVING AN AIR-CUSHIONED SHOULDER STRAP

(76) Inventor: Charles Chen, No. 70-5, Yueh-Hu Rd. Hou-Li Hsiang, Taichung Hsien (TW)

( * ) Notice: Subject to any disclaimer, the term of this patent is extended or adjusted under 35 U.S.C. 154(b) by 0 days.

(21) Appl. No.: 09/459,232

(22) Filed: Dec. 10, 1999

(51) Int. Cl.[7] ..... A41F 15/02
(52) U.S. Cl. ..... 224/264; 224/643
(58) Field of Search ..... 224/264, 642, 224/643

(56) References Cited

U.S. PATENT DOCUMENTS 1,444,157 * 2/1923 Lee ..... 224/264
3,435,867 * 4/1969 Hyden ..... 224/643 X
3,883,053 * 5/1975 Pritchard et al. ..... 224/264
4,384,602 * 5/1983 Ores ..... 224/264 X
5,361,957 * 11/1994 Weintraub ..... 224/264
5,429,288 * 7/1995 Sattler ..... 224/643 X
5,957,356 * 9/1999 Potempa ..... 224/643
6,109,495 * 8/2000 Hernandez ..... 224/644

* cited by examiner

*Primary Examiner*—Stephen K. Cronin
(74) *Attorney, Agent, or Firm*—Ladas & Parry

(57) ABSTRACT

A bag includes a bag body, a shoulder strap, and an air pocket. The shoulder strap has two ends attached to the bag body, and an envelope part sewn to the shoulder strap. The air pocket is received in the envelope part to provide a long-term cushioning effect.

7 Claims, 9 Drawing Sheets

BAG HAVING AN AIR-CUSHIONED SHOULDER STRAP

BACKGROUND OF THE INVENTION

1. Field of the Invention

This invention relates to a bag, more particularly to a bag having an air-cushioned shoulder strap.

2. Description of the Related Art

Referring to FIGS. 1 and 2, a conventional cushion member is shown to comprise a rubber pad 101 which is made of polyvinyl chloride and which is movable along a shoulder strap 1 of a bag. The rubber pad 101 is elongated, and has two holes 102 formed adjacent to two ends thereof. The shoulder strap 1 passes through the holes 102 in the rubber pad 101, and the rubber pad 101 is movable to contact the shoulder of a user for cushioning purposes. However, since the rubber pad 101 is relatively hard and lacks sufficient elasticity, the cushioning effect is not satisfactory.

Referring to FIG. 3, another conventional cushion member is shown to comprise a soft pad 201 that is sewn on a shoulder strap 2 of a bag. The soft pad 201 has a covering 203 and a sponge or foamed material 202 housed within the covering 203. Although the soft pad 201 is relatively soft and provides a good cushioning effect, fatigue of the sponge or foamed material 202 will result in poor elasticity of the soft pad 201 after the soft pad 201 has been in used for a period of time.

SUMMARY OF THE INVENTION

The object of the present invention is to provide a bag having a shoulder strap with a cushion member that can provide a good and long-term cushioning effect.

According to the present invention, a bag comprises a bag body, a shoulder strap, and an air pocket. The shoulder strap has two ends attached to the bag body, and an envelope part sewn to the shoulder strap. The air pocket is received in the envelope part to provide a long-term cushioning effect.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
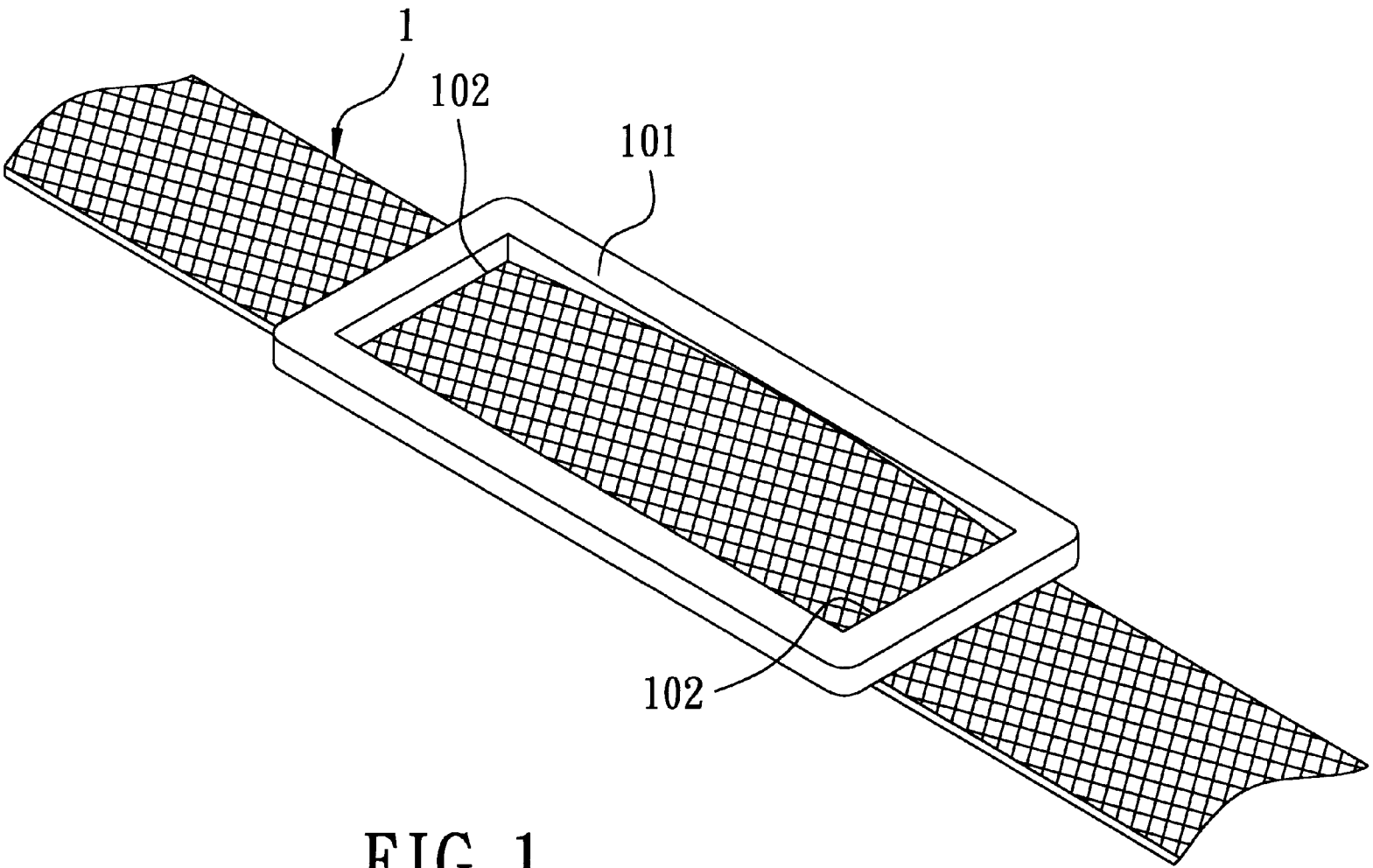
FIG. 1 PRIOR ART
FIG. 1 is a perspective view of a conventional cushion member.
Figure 2:
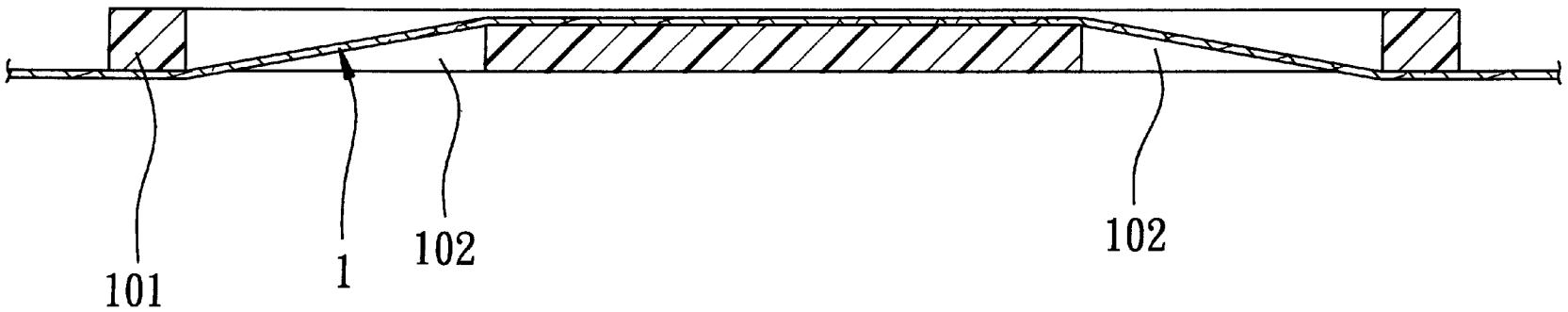
FIG. 2 PRIOR ART
FIG. 2 is a cross sectional view of the conventional cushion member of FIG. 1.
Figure 3:
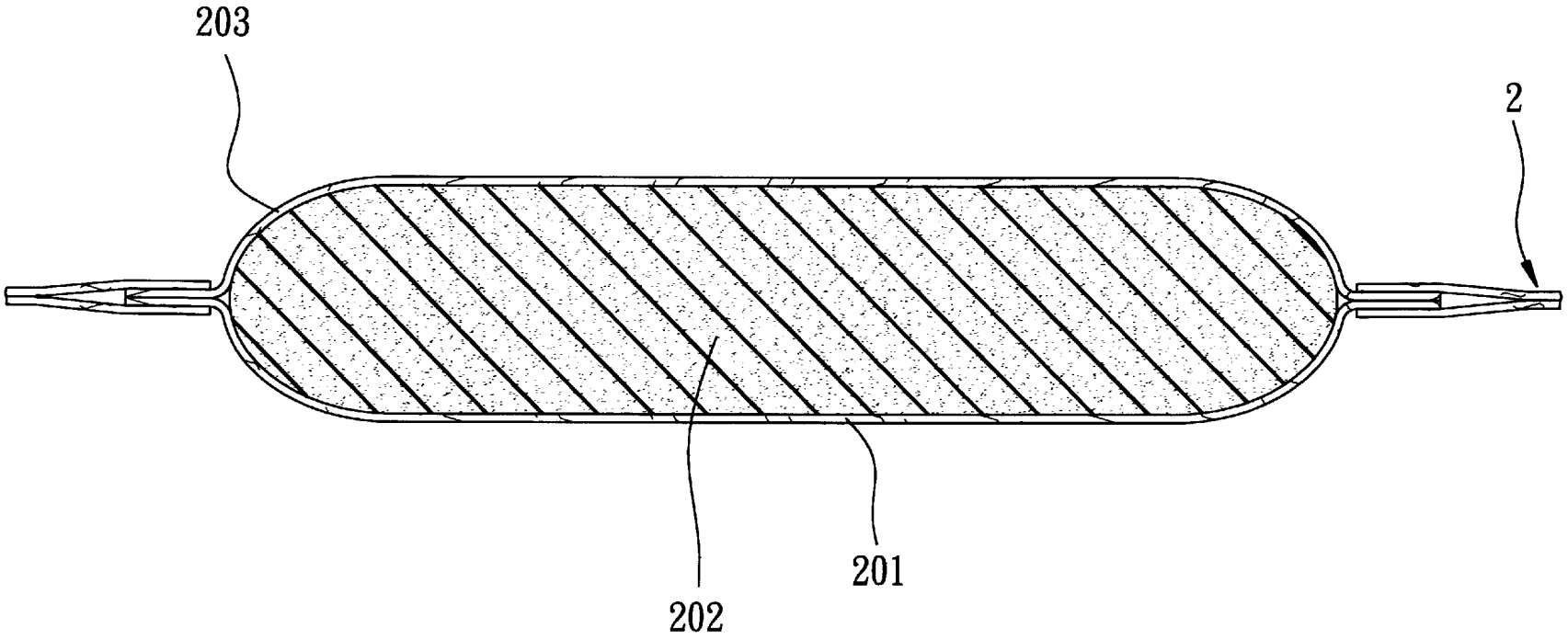
FIG. 3 PRIOR ART
FIG. 3 is a cross sectional view of another conventional cushion member.
Figure 4:
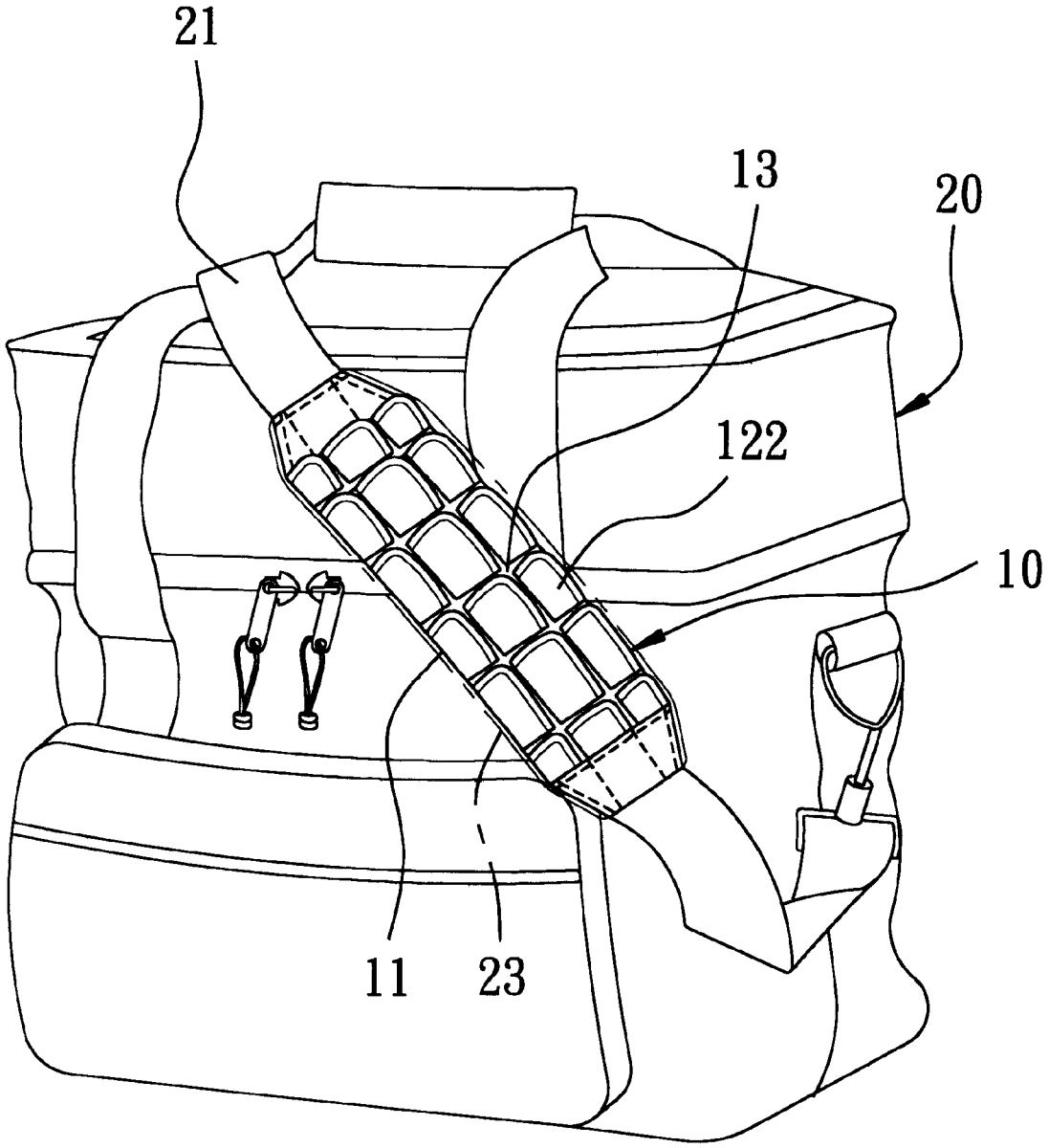
FIG. 4 is a perspective view of a first preferred embodiment of a bag according to the present invention.

Referring to FIG. 4, a first preferred embodiment of a bag according to the present invention is shown to comprise a bag body 20, a shoulder strap 21, and an air pocket 10. The shoulder strap 21 has two ends attached to the bag body 20, and an envelope part 23 sewn to the shoulder strap 21. The air pocket 10 is received in the envelope part 23. The air pocket 10 is made of a thermoplastic polyurethane. However, the air pocket 10 may be made of polyvinyl chloride, or a thermoplastic rubber.

Figure 5:
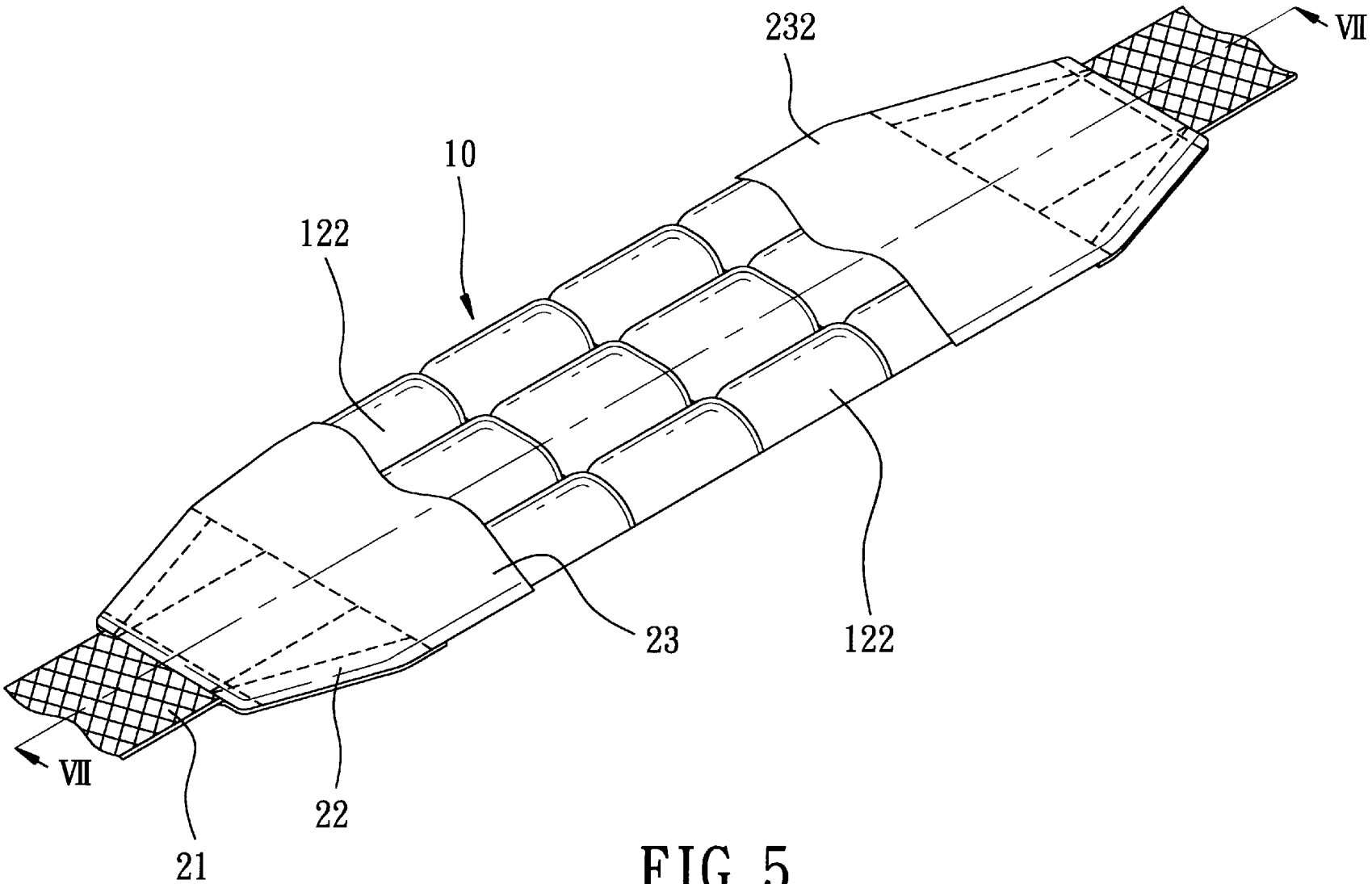
FIG. 5 is a fragmentary perspective view of a shoulder strap of the first preferred embodiment of the bag according to the present invention, illustrating a front face of an air pocket attached to the shoulder strap.
Figure 6:
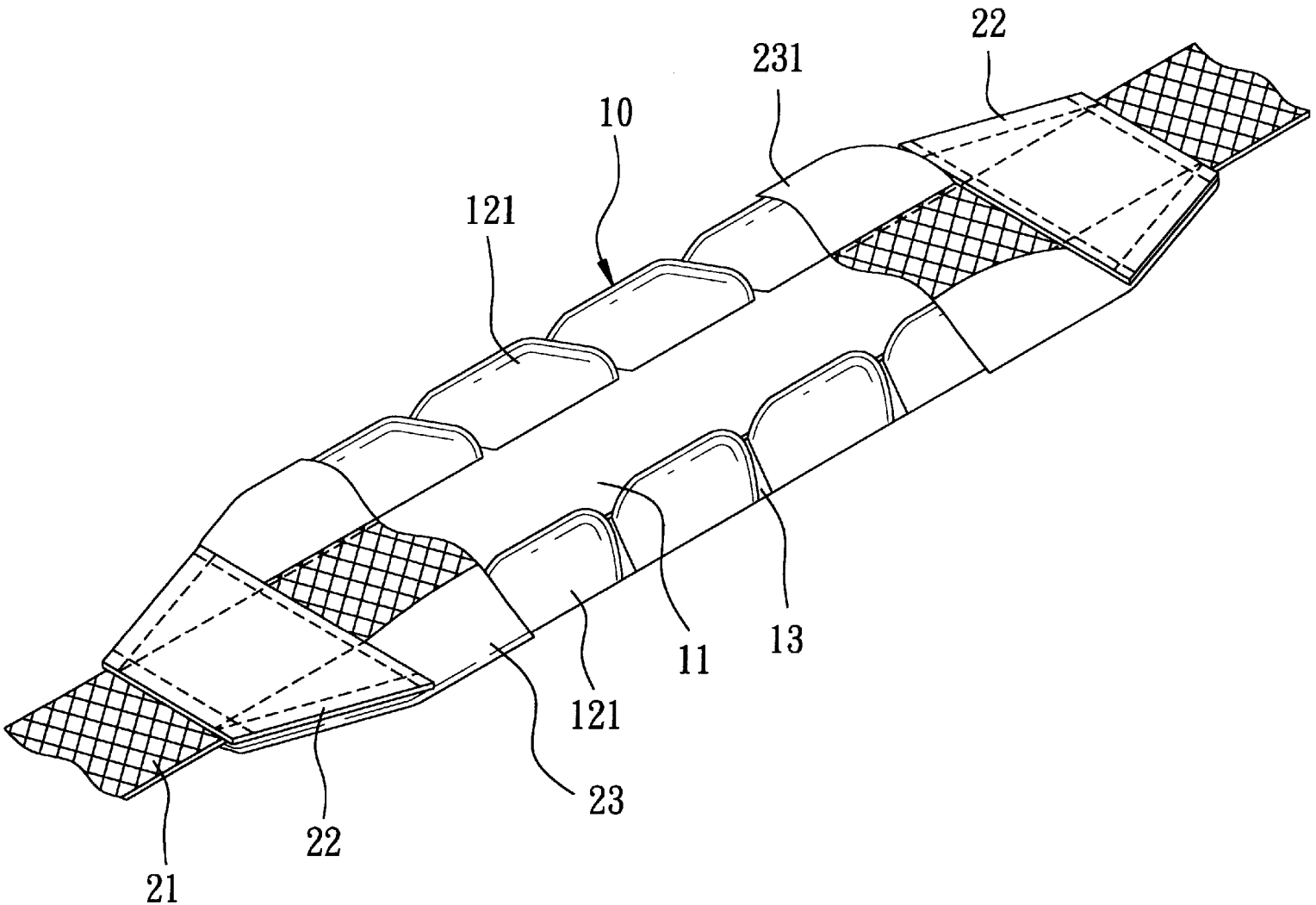
FIG. 6 is view similar to FIG. 5, illustrating a back face of the air pocket in FIG. 5.
Figure 7:
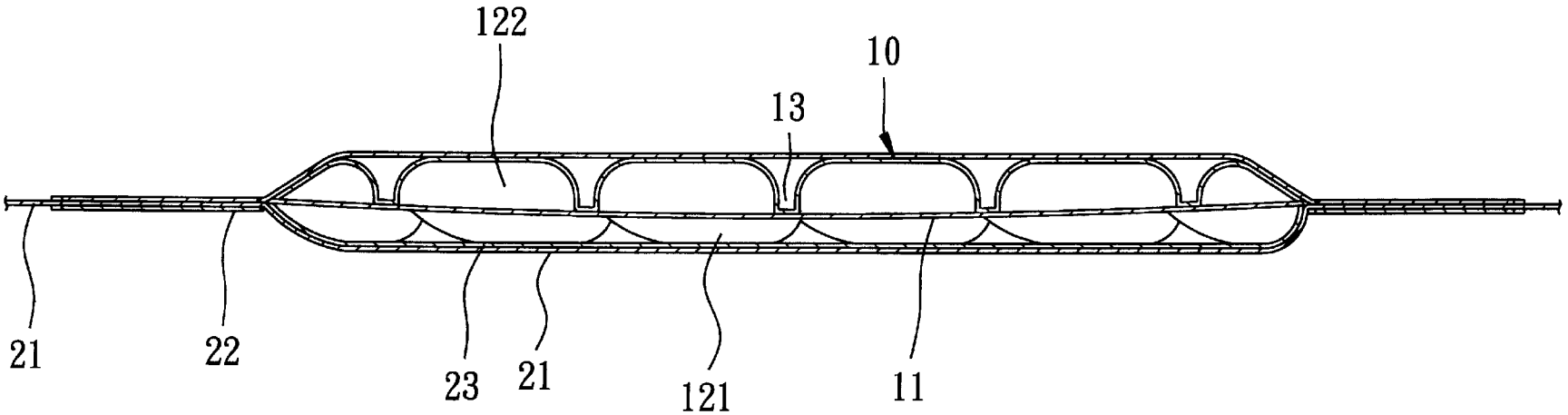
FIG. 7 is a cross sectional view taken along the line VII—VII of FIG. 5.

Referring to FIGS. 4 in conjunction with FIGS. 5, 6 and 7, the envelope part 15 and the air pocket 10 are elongated longitudinally of the shoulder strap 21. The air pocket 10 is formed as a unitary body and includes a plurality of rows of non-communicating air chambers 12 that are arranged longitudinally of the air pocket 10. The envelope part 23 has a first side 231 and a second side 232 opposite to the first side 231. The shoulder strap 21 is sewn to the first side 231. The air pocket 10 includes two rows of the air chambers 12 on two sides of the shoulder strap 21 at the first side 231, as best illustrated in FIG. 6, and three rows of the air chambers 122 extending at the second side 232 substantially in alignment with the shoulder strap 21 and the two rows of the air chambers 121, as best illustrated in FIG. 5. The air chambers 121, 122 are formed on a body sheet 11 of the air pocket 10 by a heat-sealing process. A plurality of heat-sealing seams 13 are formed among the air chambers 121, 122. Two reinforcement pieces 22 are sewn respectively on two opposite ends of the envelope part 23 and the shoulder strap 21. Since the air pocket 10 possesses an excellent elasticity and structural strength, it can provide a good long-term cushioning effect for the shoulder strap 21 of the bag.

Figure 8:
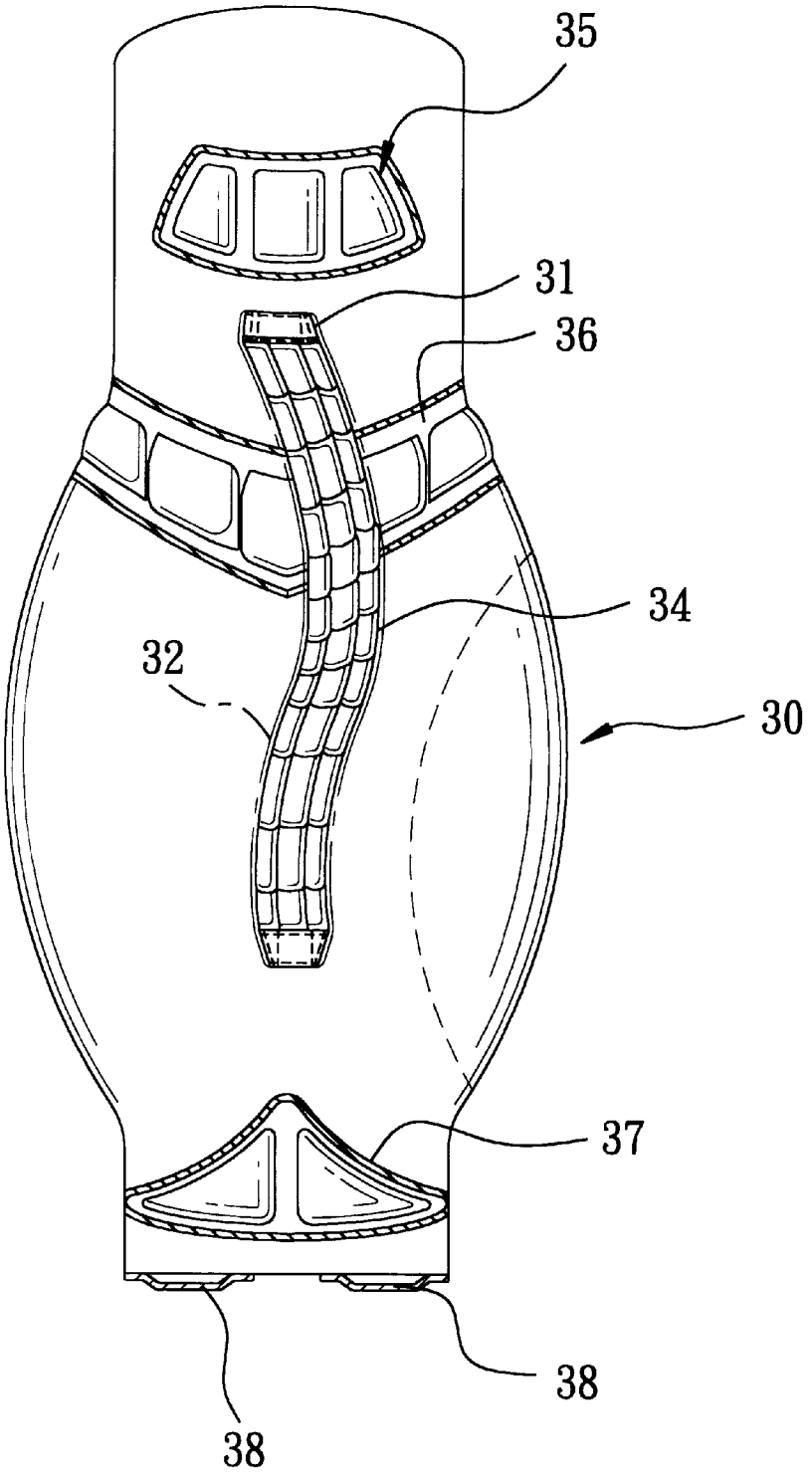
FIG. 8 is schematic view of a second preferred embodiment of a bag according to the present invention.

Referring to FIG. 8, a second preferred embodiment of a bag according to the present invention is shown to comprise a bag body 30, a shoulder strap 31, an envelope part 32, and an air pocket 34 received in the envelope part 32. In this embodiment, the bag body 30 is a golf bag. The structures of the envelope part 32 and the air pocket 34 are the same as those of the envelope part 23 and the air pocket 10 of the first preferred embodiment. The shoulder strap 31 is sewn to the bag body 30 at two ends thereof. As such, the air pocket 34 on the shoulder strap 31 can provide a good long-term cushioning effect. The bag body 30 further has an upper air cushion member 35 adjacent to a top end thereof, a lower air cushion member 37 adjacent to a bottom face thereof, an intermediate air cushion member 36 between the upper and lower air cushion members 35, 37, and two bottom air cushion members 38 attached to the bottom face to serve as a cushioned base. As such, the upper, lower and intermediate air cushion members 35, 37, 36, can contact different parts of the user's body to provide an excellent cushioning effect when the user carries the bag body 30.

Figure 9:
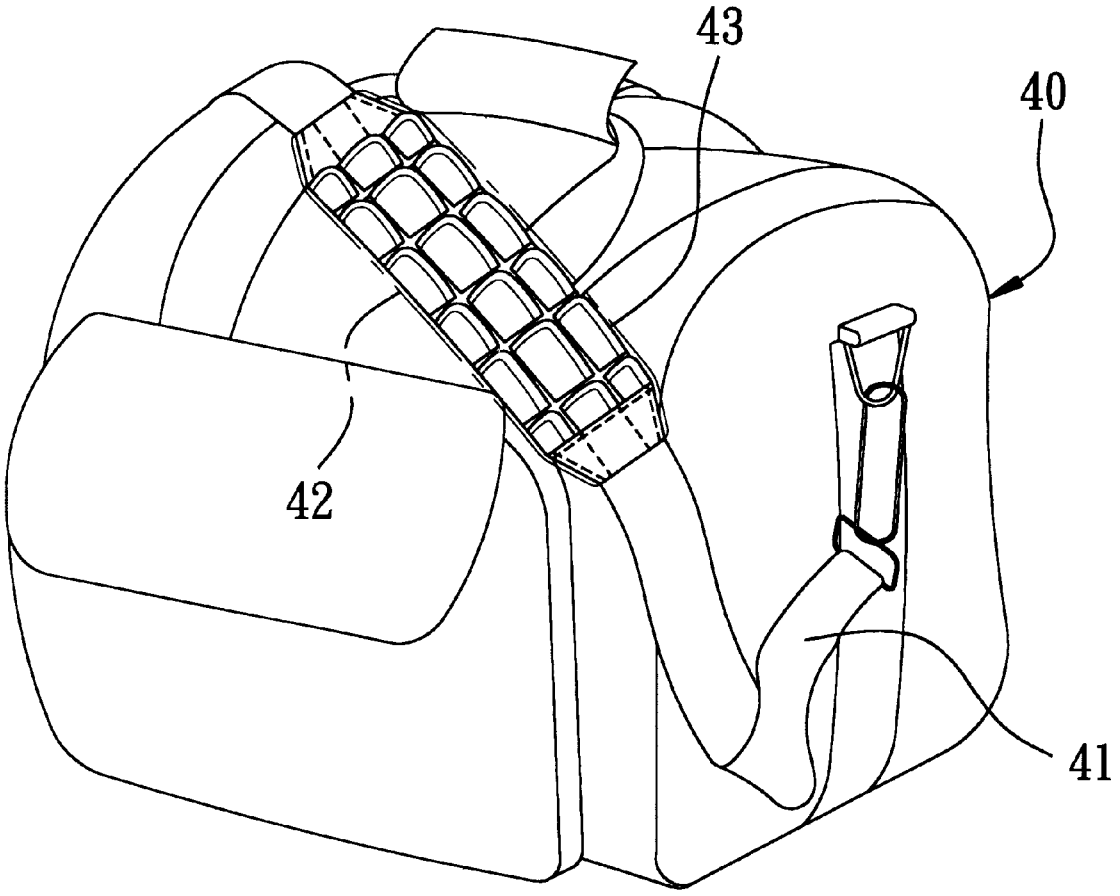
FIG. 9 is a perspective view of a third preferred embodiment of a bag according to the present invention.

FIG. 9 illustrates a third preferred embodiment of a bag according to the present invention. In this embodiment, the bag comprises a ball bag body 40, a shoulder strap 41, an envelope part 42, and an air pocket 43 received in the envelope part 42. The structures of the envelope part 42 and the air pocket 43 are the same as those of the envelope part 23 and the air pocket 10 of the first preferred embodiment. The air pocket 43 on the shoulder strap 41 can provide a good long-term cushioning effect when the user carries the bag body 40.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A bag comprising:

a bag body;

a shoulder strap having two ends attached to said bag body, and an envelope part sewn to said shoulder strap; and an air pocket received in said envelope part, wherein said envelope part has a first side and a second side opposite to said first side, said shoulder strap being sewn to said first side, said air pocket including two rows of said air chambers on two sides of said shoulder strap at said first side, and three rows of said air chambers extending at said second side substantially in alignment with said shoulder strap and said two rows of said air chambers.

2. The bag as claimed in claim 1, wherein said envelope part and said air pocket are elongated longitudinally of said shoulder strap, said air pocket being formed as a unitary body and including a plurality of rows of non-communicating air chambers which are arranged longitudinally of said air pocket.

3. The bags as claimed in claim 1, wherein said bag body is a golf bag and has a top end, a bottom face, an upper air cushion member adjacent to said top end, a lower air cushion member adjacent to said bottom face, an intermediate air cushion member between said upper and lower air cushion members, and a bottom air cushion member attached to said bottom face.

4. The bags as claimed in claim 1, wherein said air pocket is made of polyurethane.

5. The bag as claimed in claim 4, wherein said air pocket is made of thermoplastic polyurethane.

6. The bag as claimed in claim 1, wherein said air pocket is made of polyvinyl chloride.

7. The bag as claimed in claim 1, wherein said air pocket is made of a thermoplastic rubber.

* * * * *